United States Patent [19]

Dunn et al.

[11] Patent Number: 4,601,153

[45] Date of Patent: Jul. 22, 1986

[54] SUSPENDED CEILING SYSTEM

[75] Inventors: James J. Dunn, Carpentersville; John S. Borucki, Bloomingdale, both of Ill.

[73] Assignee: Chicago Metallic Corporation, Chicago, Ill.

[21] Appl. No.: 744,625

[22] Filed: Jun. 14, 1985

[51] Int. Cl.[4] ..... E04B 5/52

[52] U.S. Cl. ..... 52/666; 52/232; 52/DIG. 5

[58] Field of Search ..... 52/232, DIG. 5, 666, 52/664, 484, 667

[56] References Cited

U.S. PATENT DOCUMENTS

| | | | |
|---|---|---|---|
| 3,193,063 | 7/1965 | Brown et al. | 52/DIG. 5 |
| 3,312,488 | 4/1968 | Lickliter et al. . | |
| 3,321,879 | 5/1967 | Purdy | 52/232 |
| 3,378,976 | 4/1968 | Meredith, Jr. . | |
| 3,746,379 | 7/1973 | Sauer | 52/667 |
| 3,921,363 | 11/1975 | Beynon . | |
| 4,106,878 | 8/1978 | Jones . | |
| 4,317,641 | 3/1982 | Sauer . | |
| 4,525,973 | 7/1985 | Vukmanic et al. . | |

FOREIGN PATENT DOCUMENTS

| | | | |
|---|---|---|---|
| 1055220 | 5/1979 | Canada | 52/DIG. 5 |
| 1095682 | 2/1981 | Canada | 52/DIG. 5 |

*Primary Examiner*—J. Karl Bell

*Attorney, Agent, or Firm*—Hill, Van Santen, Steadman & Simpson

[57] ABSTRACT

A suspended ceiling system having a main runners or members extending parallel with cross-members spaced therealong to form rectangular sections, the cross-members being provided with tongues extending from the end and received in apertures or slots in the main member with the tongues being provided with a catch surface coacting with a shoulder on the tongue to hold the tongue as it is inserted into the aperture of the main runner. Each of the tongues are provided in coacting engagement and abutment surfaces which lock the two tongues together in an end-to-end connection when inserted from opposite sides of the main runner.

15 Claims, 7 Drawing Figures

FIG. 1
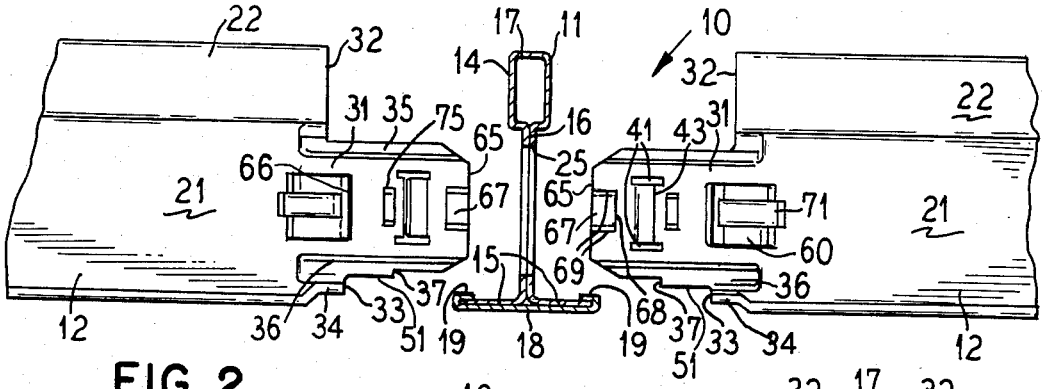
FIG. 2
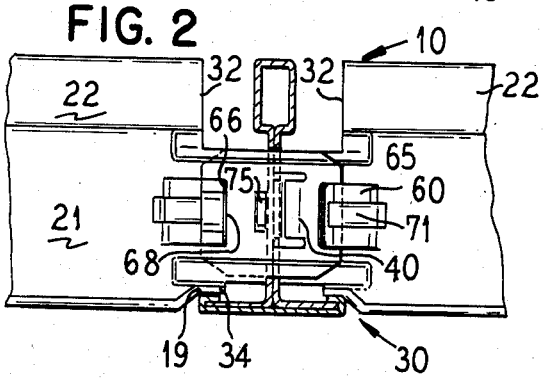
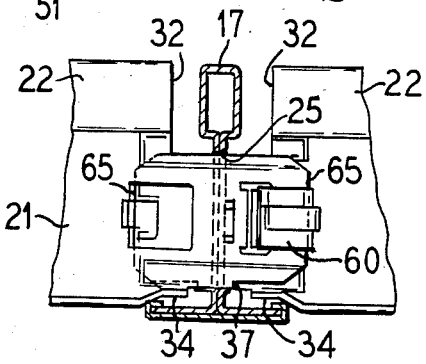
FIG. 7
FIG. 3
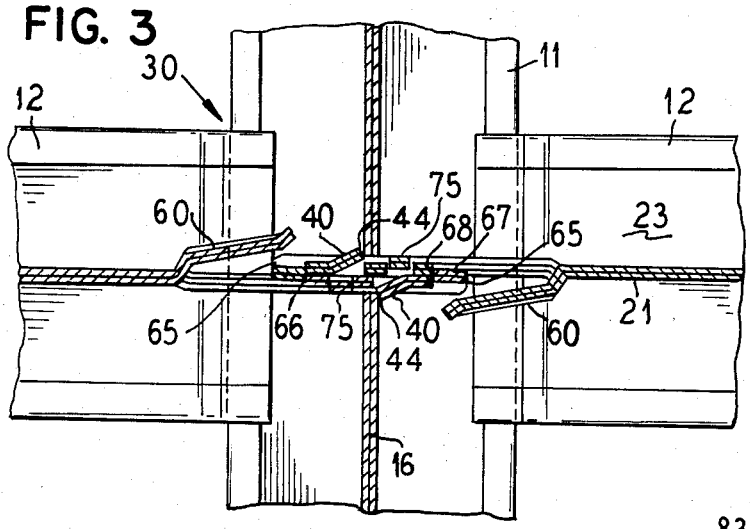
FIG. 6
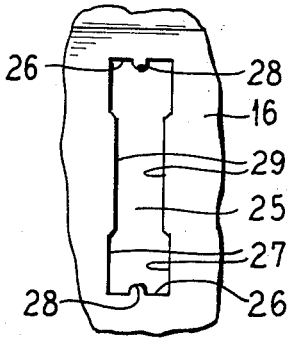
FIG. 4
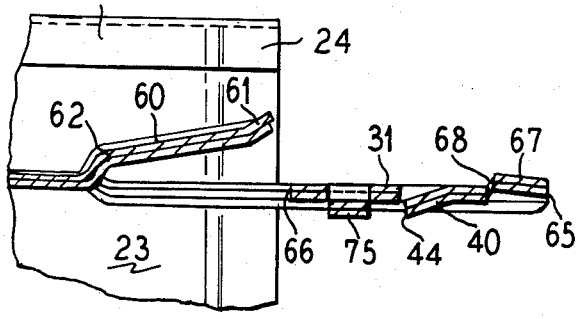
FIG. 5
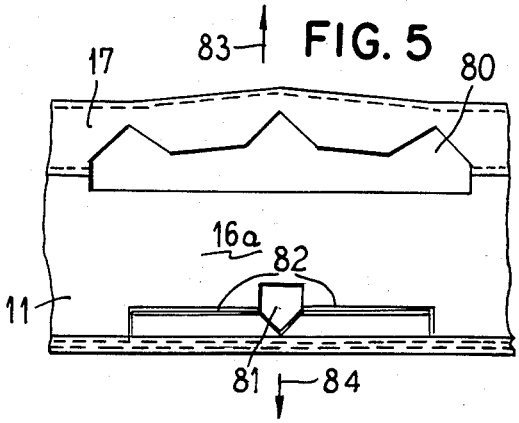

SUSPENDED CEILING SYSTEM

BACKGROUND OF THE INVENTION

The present invention is directed to a connection between a cross member and a main member for a suspended ceiling support structure which has a plurality of main runners or members extending parallel to each other and cross-members extending between the main members or runners at spaced intervals. In particular, the connection allows for expansion of the cross-member which is created by an elevated temperature such as a fire so that the suspended ceiling support structure will be a fire-rated structure. Each of the members has an inverted T configuration with a pair of oppositely extending flanges connected by a web portion to a bead. The connection for attaching the cross-members to the main member comprises a tongue extending from the end of the cross-member through an elongated slot in the web of the main member. To hold the tongue in the slot the tongue is provided with a shoulder and an abutment surface which will engage the web adjacent the slot on opposite sides. In addition, the tongue is provided with another abutment surface adjacent an end which is received by an engagement surface of the adjacent tongue to hold the two members from opposite sides together.

Suspended ceiling support systems or structures which utilize a plurality of main runners and cross-members are shown in a number of U.S. patents and one such system is described in copending U.S. application Ser. No. 569,454, filed Jan. 9, 1984 and, which issued as U.S. Pat. No. 4,525,973 on July 2, 1985 and is assigned to the assignee of the present application. In the arrangement disclosed in this patent application, the beads on the edge of the flange of the cross-member are cut relative to the tongue so that when the tongue is inserted through a slot in the web of the main member, the bead is in contact with the bead of the main member as the edges of the end surfaces of the flanges of the cross-member are engaging the edges of the flanges of the main member. This arrangement will not allow for expansion at the connection due to increased temperatures which are caused by a fire.

In another type of construction for cross-members, it is known to provide an offset portion in the flanges of the cross-members at the end so that when the tongue is inserted in a slot in the web of the main member, the offset portion is received on the edge of the flange of the main member. Examples of this are disclosed in U.S. Pat. Nos. 3,312,488; 3,378,976; 3,921,363 and 4,317,641. Each of these patents have shoulders provided on the tongue which limit the depth of insertion of the tongue into the slot in the web of the main member. In the arrangement disclosed in U.S. Pat. No. 3,378,976, the shoulder is formed on an extension which will buckle when the ceiling framework is subjected to a large amount of heat to allow the tongue to extend further in as the flanges of the cross-member ride up over the flanges of the main member. In U.S. Pat. Nos. 3,921,363 and 4,317,641, to provide for fire rating, the shoulders are formed by tabs which will shear off to allow penetration of the tongue further into the slot due to expansion of the cross-member. In the arrangement in U.S. Pat. No. 3,312,488, the tongue is a separate member which is secured on the web of the cross-member and has two thicknesses with the shoulder being on one layer which engages projections extending into the aperture or slot. Due to the size of these projections, they will be sheared or bent out of the plane of the web when a certain force is applied by the tongue thereto. With this last-mentioned arrangement, added cost for providing the tongue occurs. With those arrangements having tabs that break off, they sometimes are accidentally broken off during handling and thus result in a damaged cross-member that cannot be used.

SUMMARY OF THE INVENTION

The present invention is directed to an improved suspended ceiling structure or system which has members with a bead connected to the opposite flange by a web with a double thickness to increase strength and has a locking means for connecting the tongue of a cross-member in a slot of the main member which includes an elongated aperture receiving the tongue and which arrangement is fire-rated because it allows for expansion of the cross-member when subjected to elevated temperatures.

To accomplish these goals, the invention is directed to a suspended ceiling system comprising main members extending parallel to each other and cross-members extending between the main members at spaced intervals, each of said members having inverted T configurations with a pair of oppositely extending flanges connected by a web portion to a bead, each cross-member having ends with the flanges terminating in an offset lip and the web portion having an integral tongue extending beyond both the end surface of the bead and flanges, each of the webs of the main member having an elongated slot for receiving the tongue of the cross-member with the offset lip of the flange of the cross-member being received on an outer edge of the flange of the main member and the bead being spaced from the bead of the main runner, each of the tongues having shoulder means for engaging the web of the main runner adjacent the elongated slot, first means cooperating with the elongated slot and the shoulder means to lock the tongue in the slot and second means cooperating with the second means of another tongue to interconnect the two tongues together to form an end-to-end joint between cross-members extending into the elongated slot from opposite directions, said first means being a tab bent from the tongue to form a catch surface facing away from the end of the tongue and toward the shoulder means, and each of the shoulder means being of a small dimension and reinforced so that during expansion of the cross-member due to an elevation above ambient temperature, said shoulder means pierces the web adjacent the slot to enable further penetration of the tongue through the web.

The advantage of the invention over the known devices of the prior art is that the shoulder means will not be damaged during handling of the cross-member to cause damage to the connection. Thus, the shoulder means will not be accidentally broken off or bent out of the desired plane of the web.

Other advantages of the system are that the second means is formed by an embossment having substantially two parallel bend portions at the end of the tongue to form an abutment surface that extends substantially perpendicular to the axis of the cross-member and a second substantially perpendicualr engagement surface formed by deforming a flap or strap from the web. The strap and embossment are bent from the web of the tongue in a direction opposite to the direction for the tab of the first means and the strap will engage the end of the cross-member extending inward from the opposite side of the web. Preferably, the web portion is a double thickness or two layers and the embossments forming the abutment surface act to hold the two layers together and the strap is also provided with an axial extending reinforcement embossment to hold the layers together. In addition, a joining stitch can be formed in a portion of the tongue adjacent to the tab of the first means by defining a portion of the tongue by an amount slightly greater than the thickness of the two layers.

In forming the first means, two parallel extending slots, which are connected by a single cut, are utilized so that the tab is free to bend in and out without binding on adjacent material of the tongue.

BRIEF DESCRIPTION OF THE DRAWINGS

FIG. 1 is an exploded view of two cross-members in accordance with the present invention about to be inserted into an aperture of a main member from opposite sides;

FIG. 2 shows a connection after insertion of the two cross-members of FIG. 1;

FIG. 3 is a cross-sectional view taken along lines III—III of FIG. 2;

FIG. 4 is an enlarged cross-sectional view taken along lines IV—IV of FIG. 1;

FIG. 5 is a partial side view of a portion of the main runners of FIGS. 1 and 2;

FIG. 6 is an enlarged view of the elongated aperture formed in the web of the T members of the present invention; and FIG. 7 is a view showing the connection after relieving expansion created by elevated temperatures.

DESCRIPTION OF THE PREFERRED EMBODIMENTS

The principles of the present invention are particularly useful in a suspended ceiling system generally indicated at 10 which comprise a plurality of main runners or members 11 and cross-members 12.

As best illustrated in FIG. 1, each of the main members or runners 11 is composed of a pair of bent sheet metal pieces or strips. One sheet metal strip 14 has a pair of right angle bends to form flanges 15,15 which are connected by a web 16 to a bead 17. As illustrated, the bead has a rectangular configuration. The other strip 18 has a sheet metal member bent over edges of the flanges 15,15 at 19 and presents a surface which will appear on the suspended ceiling. The strip 18 can be provided with paint of different colors in accordance with the desired aesthetic requirements. Each of the cross-members or T's 12 have the same configuration and structure as the main member or runner 11 with a web 21 interconnecting a rectangular bead 22 to a pair of flanges 23,23 which are covered on the bottom by an additional strip 24 (see FIG. 4).

The web 16 has an elongated aperture or slot 25 which is best illustrated in FIG. 6. As illustrated, the slot 25 has a substantially rectangular configuration with short sides 26,26 and long sides 27,27. Each of the short sides is provided with a projection or nib 28 while each of the long sides has a shallow projection 29. The function of the projection 28 as well as the shallow projection 29 will be discussed hereinafter.

In order to form a connection generally indicated at 30 in FIGS. 2 and 3, each of the webs 21 of the cross-members has a tongue 31 which extends beyond both an end surface 32 of the bead 22 and also the end surface 33 of the flanges 23. As best illustrated in FIGS. 1 and 2, the flanges 23 adjacent the end surface 33 has an offset portion 34 which is offset from the plane of the remaining portions of the flanges by an amount equal to the thickness of the flanges 15 of the main runner 11 which is covered by the bent-around strip 18 for the main runner 11. Thus, with the tongues 31 being inserted in the slot or aperture 25 as illustrated in FIG. 2, the offset portion 34 of the flange 23 rides on the bent portion 19 of the strip 18 (FIG. 2). It is also noted that the end surface 32 is spaced from the bead 17 by a substantial distance so that the end surface 32 is approximately in a line with the edge of the flange 15.

As illustrated in FIGS. 3 and 4, each of the tongues 31 is offset approximately half the thickness of the web 21 and has embossments 35 and 36 along the upper and lower edges to reinforce or stiffen the tongue. This will give the tongue a slight bowed configuration which will conform to one-half of the shape of the aperture 25 when subdivided by the two projections or nibs 28,28.

To hold the tongue 31 in the slot 25, the tongue has shoulder means formed by a shoulder 37 in the lower embossment 36 of the tongue and also first means. In addition, each of the tongues has second means which cooperate with the second means of an adjacent tongue coming from the opposite direction to lock the two tongues together and in the aperture 25. As illustrated in FIGS. 1-4, the first means includes a flap or tab 40 which is bent from the tongue. The tab is formed by a pair of longitudinally extending slots 41 and 42 which are interconnected by a vertically extending slot or cut 43. The purpose of the slots 41 and 42 is to prevent binding of the tab 40 as it is bent from the plane of the tongue. The position of the slot 43 relative to the shoulder 37 is such that as the shoulder 36 engages one side of the web, an edge 44 of the tab 40 engages the opposite side of the web 16 preferably in the area of one of the shallow projections such as 29.

The second means, which coacts with the second means of the tongue inserted from the opposite side to form an end-to-end connection includes a tab or strap 60 which is cut and formed as best illustrated in FIG. 4 to the opposite side of the tab 40. The tab 60, as illustrated, has several intermediate bends such as 61 and 62 and forms a pocket-like element to catch a free end 65 of the other tongue (see FIGS. 2 and 3). Also, the forming of the tab or strap 60 creates an aperture with an edge forming an abutment or engagement surface 66. Adjacent the free end 65 of the tongue another embossment or projection 67 is formed to provide an abutment surface 68. The projection 67 is formed with a rectangular configuration having a pair of bends 69 (FIG. 1) so that the abutment surface 68 is a substantially vertical surface with respect to the axis of the member 12. The formation of the projection 67 with two parallel bends 69,69 has the advantage of holding the two layers of the web 21 together in the area of the tongue and to provide reinforcing to stiffen the tongue. In a similar manner, the tab or strap 60 is provided with an axially extending boss 71 which provides reinforcement. As illustrated in FIGS. 2 and 3, when the tongues are inserted through the aperture 25 and received in the strap or tab of the opposite member, there is a substantial distance from the free end 65 of the tongue to the end of the pocket which is adjacent bend 61. This allows the tongues to move further into the pockets when elongation occurs due to heating (see FIG. 7).

In addition to the reinforcement caused by the embossment 71 and the bends 69,69, a stitch 75 is provided between the tab 60 and the cut line 43. The stitch as illustrated is a depression of approximately the thickness of the two layers of the web so that the two layers are pressed relative to the remaining portion to cause a holding force between the two layers.

As mentioned hereinbefore, the shoulder means 37 is formed in the lower portion of the tongue such as the edge portion 51. The shoulder means is selected to have a small area which is only sufficient enough to prevent or stop the insertion of the tongue through the aperture 28. However, when sufficient force caused by expansion of the member 12 due to elevation such as created during a fire will allow the surface 37 to pierce through the web 15 adjacent the aperture 25 so that the entire tongue can be further inserted through the aperture to relieve stresses due to expansion (see FIG. 7). As this occurs, the offset portion 34 of the flanges will ride up over the flanges of the main runner and the only limit to the amount of insertion will be engagement of the end surface 32 with the bead 17 of the main runner or the engagement of the free end 65 of the tongue with the base of the pocket formed by the tab 60.

The main runner is also provided with means to compensate for thermal expansion. This can be means such as illustrated in FIG. 5 which comprises an aperture 80 which is cut in part of the web 16 of the main runner as well as part of the bead 17 of the main runner. In addition, a second aperture 81 and a slot 82 adjacent the flanges 15 are provided. During thermal expansion, the bead 17 will move or bend in the direction of arrow 83 while the flange 15 will move or bend in the direction of the arrow 84 and the intermediate web portion **16*a* between the apertures 80, 81 and 82** can bend laterally. This control bending of the web, bead and flanges prevents undesirable buckling of the runner.

By providing the main runners with the means for relieving expansion as well as by providing the tongues with the shoulder 37 capable of piercing through the web, the system becomes a fire-rated suspended system which will not be twisted or buckled during a fire.

As mentioned hereinabove, the shoulder 37 has a size which enables catching a portion of the web adjacent the bottom of the aperture 25 but which shoulder 37 can be driven through the web due to expansion created by heat from a fire. It has been found with webs having a thickness in the range of 0.030 that a shoulder of 0.04 will provide enough of a stop to prevent insertion of the tongue but will enable piercing the web of the main runner when subjected to heat from a fire.

Although various minor modifications may be suggested by those versed in the art, it should be understood that we wish to embody within the scope of the patent granted hereon, all such modifications as reasonably and properly come within the scope of our contribution to the art.

We claim:

1. A suspended ceiling system comprising main members extending parallel to each other and cross-members extending between the main members at spaced intervals, each of said members having an inverted T configuration with a pair of oppositely extending flanges connected by a web to a bead, each cross-member having ends with the flanges terminating in an offset lip and the web having an integral tongue extending beyond both the end surfaces of the bead and flanges, each of the webs of the main runners having elongated slots for receiving the tongue of the cross-member with the offset lip of the flange of the cross-member being received on an outer edge of the flange of the main member and the bead being spaced from the bead of the main member, each of the tongues having shoulder means for engaging the web of the main runner adjacent the elongated slot, first means cooperating with the elongated slot and the shoulder means to lock the tongue in the slot and second means cooperating with the second means on another tongue to interconnect the two tongues together to form an end-to-end joint between cross-members extending in the elongated slot from opposite directions, said first means being a tab bent from the tongue to form a catch surface facing away from the end of the tongue and toward said shoulder means, said shoulder means being of a dimension to limit insertion of the tongue into the slot but able to pierce the web of the main member adjacent the elongated slot when the system is subjected to heat to cause thermal expansion of the cross-member.

2. A suspended ceiling system according to claim 1, wherein the second means includes an embossment adjacent a free end of the tongue and a flap formed in the base of the tongue to provide a pocket, said embossment and flange extending to a side of the tongue opposite to the tab, said embossment having parallel bent portions to provide an abutment surface extending substantially at right angles to an axis of the cross-member, said flap creating an aperture having an engagement edge so that the abutment surface of the embossment will be engaged on the engagement edge of the other cross-member as the free end is received in the pocket formed by the flap when the two cross-members are inserted from opposite sides through the aperture and the web of the main member.

3. A suspended ceiling system according to claim 2, wherein the webs of the cross-members are formed of two layers and the tongue has means for holding the two layers together.

4. A suspended ceiling system according to claim 3, wherein said means for holding the two layers together include a stitch formed in the tongue between the engagement surface and the tab of the first means.

5. A suspended ceiling system according to claim 4, wherein the means for holding the two layers together include a longitudinal embossment in the flap forming the second means and the two bent portions forming the embossment of the second means.

6. A suspended ceiling system according to claim 2, wherein the flap of the second means forms a pocket having a depth greater than the amount of the free end of the tongue so that during a fire, the pocket can receive the additional portion of the tongue forced through the aperture in the main runner.

7. A suspended ceiling system according to claim 6 which includes an embossment in the flap of the second means to reinforce the pocket.

8. A suspended ceiling system according to claim 7, wherein the web is formed of two layers and said embossment in the flap of the second means acts to hold the two layers forming the flap together.

9. A suspended ceiling system according to claim 8 which includes additional means for holding the two layers of the tongue together, said additional means including a deformation stitch formed in the tongue between the engagement surface and the tab of the first means.

10. A suspended ceiling system according to claim 1, wherein the main runners are provided with means to enable expansion due to heat so that the system will not buckle when subjected to heat produced by a fire.

11. A cross-member for use in a suspended ceiling system having main members extending parallel to each other, said main members having an inverted T configuration with a pair of oppositely extending flanges connected by a web to a bead, said main members having an elongated slot at the position for receiving the cross-members, said cross-member having an inverted T configuration with a pair of oppositely extending flanges connected by a web to a bead, said cross-member at an end having the flanges terminating in an offset lip and the web having an integral tongue extending beyond both end surfaces of the bead and flanges, said tongue being receivable in a slot of the main member with the offset lip of the flange of the cross-member being received on an outer edge of the flange of the cross-member and the bead being spaced from the bead of the main member, said tongue having a shoulder means for engaging the web of the main member adjacent the elongated slot, first means for cooperating with the elongated slot and the shoulder means to lock the tongue in the slot and second means cooperating with second means of another tongue to interconnect the two tongues together in an end-to-end joint between cross-members extending in the elongated slot from opposite directions, said first means being a tab bent from the tongue to form a catch surface facing away from the end of the tongue and toward said shoulder means, said shoulder means being of a dimension to limit insertion of the tongue into the slot but able to pierce the web of the main member adjacent to the elongated slot when the system is subjected to heat to cause thermal expansion of the cross-member.

12. A cross-member according to claim 11, wherein the second means includes an embossment adjacent the free end of the tongue and a flap formed in the base of the tongue to provide a pocket, said embossment and flap extending to a side of the tongue opposite to the tab, said embossment having parallel bent portions to provide an abutment surface extending substantially at right angles to an axis of the cross-member, said flap creating an aperture having an engagement edge so that the abutment surface of the embossment will be engaged on the engagement edge of the other cross-member as the free end is received in the pocket formed by the flap when the two cross-members are inserted from opposite sides through the aperture of the web of the main member.

13. A cross-member according to claim 12, wherein the web of the cross-member is formed of two layers and the tongue has means for holding the two layers together.

14. A cross-member according to claim 13, wherein the means for holding the layers together include a stitch formed in the tongue between the engagement surface and the tab of the first means.

15. A cross-member according to claim 14, wherein the means for holding the two layers together includes a longitudinal embossment in the flap forming the second means and the two bent portions forming the embossment of the second means.

* * * * *